US007163316B2

(12) United States Patent
Wu

(10) Patent No.: US 7,163,316 B2
(45) Date of Patent: Jan. 16, 2007

(54) MULTI-FUNCTIONAL ORNAMENTAL LIGHTING EQUIPMENT

(76) Inventor: Jeng-shyong Wu, No. 14, Alley 1, Lane 326, Shin-Pin Road, Hsinchu (TW)

( * ) Notice: Subject to any disclaimer, the term of this patent is extended or adjusted under 35 U.S.C. 154(b) by 281 days.

(21) Appl. No.: 10/920,920

(22) Filed: Aug. 18, 2004

(65) Prior Publication Data

US 2006/0039146 A1 Feb. 23, 2006

(51) Int. Cl.
*F21S 13/14* (2006.01)

(52) U.S. Cl. ..... 362/252; 362/227

(58) Field of Classification Search ..... 315/185 R, 315/291, 312–318; 362/251–252, 276–277, 362/227, 802

See application file for complete search history.

(56) References Cited

U.S. PATENT DOCUMENTS 4,656,398 A * 4/1987 Michael et al. ..... 315/293
5,645,342 A * 7/1997 Chang ..... 362/252
5,984,491 A * 11/1999 Chang ..... 362/252
5,994,845 A * 11/1999 Gibboney, Jr. ..... 315/185 S
6,693,395 B1 * 2/2004 Wilhelm ..... 315/291
6,808,289 B1 * 10/2004 Reed ..... 362/198
7,026,768 B1 * 4/2006 Ruiz ..... 315/185 R
2002/0154787 A1 * 10/2002 Rice et al. ..... 381/124
2003/0206411 A9 * 11/2003 Dowling et al. ..... 362/234
2005/0024877 A1 * 2/2005 Frederick ..... 362/277
2005/0237734 A1 * 10/2005 Krieger ..... 362/157

* cited by examiner

*Primary Examiner*—Hoanganh Le
*Assistant Examiner*—Tung Le
(74) *Attorney, Agent, or Firm*—McGlew & Tuttle, PC

(57) ABSTRACT

A multi-functional ornamental lighting equipment is set forth. This equipment comprises an ornamental lighting load connected to form a plurality of branch circuits; a function controller formed of a variety of electric and electronic components operable for various prescribed functions, and having a power supply input terminal and an output terminal to the multi-branched circuit; a protective housing for enclosing the function controller; a connector unit connected with the protective housing and admitting to joint a plurality of conductors within it, one terminal of the conductors being connected to the output terminal of the function controller, while the other terminal thereof being connected to the ornamental lighting load; and a power supply connected to the input terminal of the function controller. With this scheme, when the power is supplied to the ornamental lighting equipment by the energized function controller via the connector unit, the lighting equipment is capable of rapidly reaching at a starting position ready for variably changing its state.

60 Claims, 8 Drawing Sheets

MULTI-FUNCTIONAL ORNAMENTAL LIGHTING EQUIPMENT

BACKGROUND OF THE INVENTION

1. Field of the Invention

The present invention relates to multi-functional ornamental lighting equipment, and more particularly, to an ornamental lighting equipment which includes a function control unit and conductor connecting means to provide the ornamental lighting load with a function to rapidly reach in a starling position to perform a variety of light changing states.

2. Description of the Prior Art

The ornamental lighting equipment which creates a joyful atmosphere is usually composed of strings of incandescent lamps or LEDs as a light source with its one end connected to a power source and resting the assembly on a supporting frame such as a Christmas tree, or a picturesquely styled stand.

In order to enhance the light variation, a function controller is provided between the power source and the lighting equipment to control the flashing fashion of the lighting equipment. In the prior arts, there were many analogous ornamental lighting equipment disclosed or put into practice such as U.S. Pat. No. 6,653,757 "Apparatus and Method for Providing Synchronized Lights", U.S. Pat. No. 6,559,605 "Synchronous Multiple Serial Lamp Sets", U.S. Pat. No. 6,170,964 "Ornamental Lighting Device with a flexibly Separable Light Emitting Tube Capable of Portraying User's Designed Signs in a Flickering Manner", U.S. Pat. No. 5,834,901 "Flashing Light String Assembly with a Pair of Sub-light Strings per Plug", and U.S. Pat. No. 5,150,964 "Joy Light Structure" etc.

All the aforesaid cited cases provided their individual features in the interconnection scheme of the ornamental lamps, but there is a significant shortcoming of disorganization in the fastening and assembling manners especially when the number of the electric conductors and lumped lamps is increased.

In view of such a defect inherent to the prior art, an improvement is seriously required.

The inventor has dedicated great efforts for years to studying and improving this defect and come up with a novel multi-functional ornamental lighting equipment as provided in this invention whose structure is sure to eliminate the defect mentioned above.

SUMMARY OF THE INVENTION

Accordingly, it is an object of the present invention to provide a multi-functional ornamental lighting equipment which is composed of an ornamental lighting load, a function controller, a plug to the power source, and a plurality of other connecting means such that the lighting load is capable of rapidly reaching in a starting position to perform a variety of light changing state according to jointed actuation of the function controller and the connecting means.

Another object of the present invention is to provide a multi-functional ornamental lighting equipment in which the assembly of the lighting equipment can be neatly and simply constructed and operated easily and conveniently through jointed actuation of the function controller and the connecting means.

The above objects and other advantages of the present invention will become more apparent by describing in detail the preferred embodiments of the present invention with reference to the attached drawings.

DETAILED DESCRIPTION OF THE PREFERRED EMBODIMENTS

Figure 1:
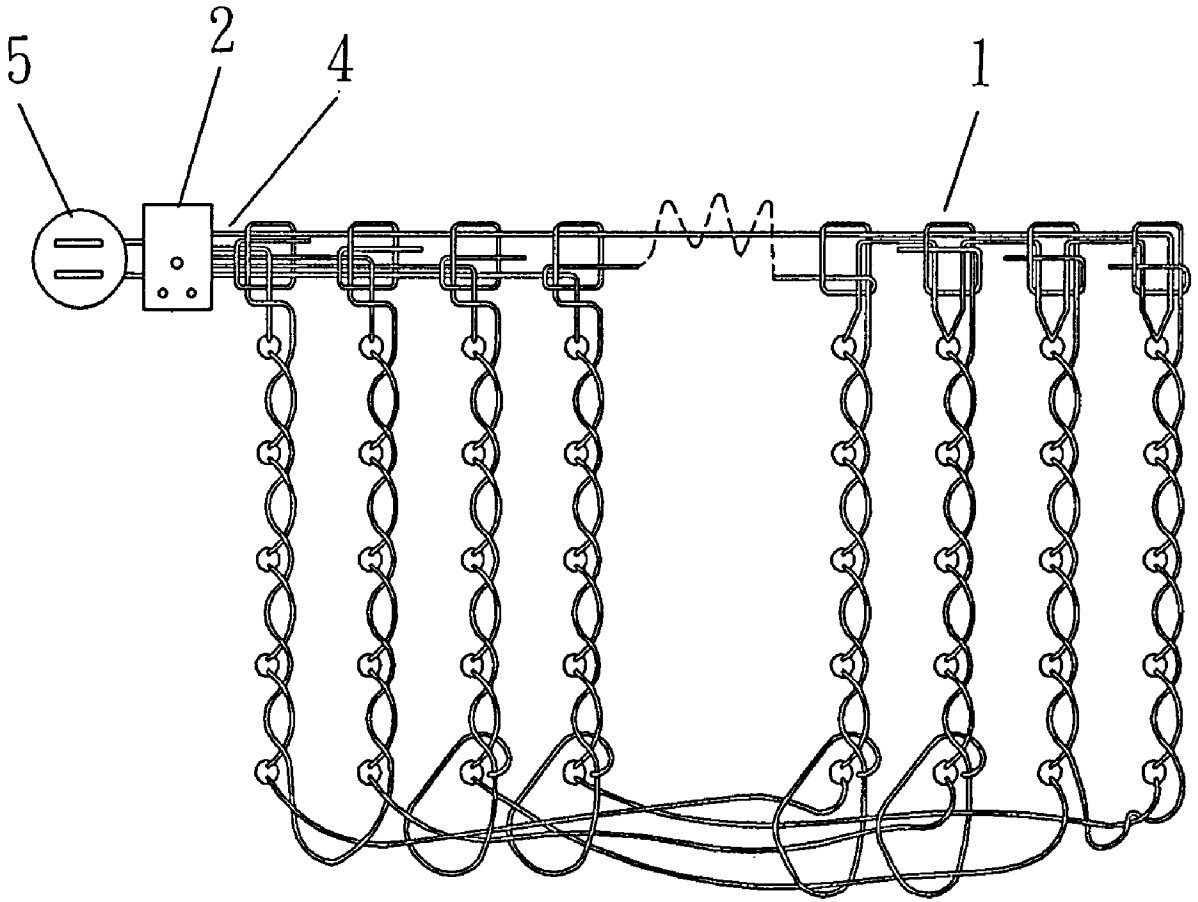
FIG. 1 is a schematic layout view of the present invention.
Figure 3:
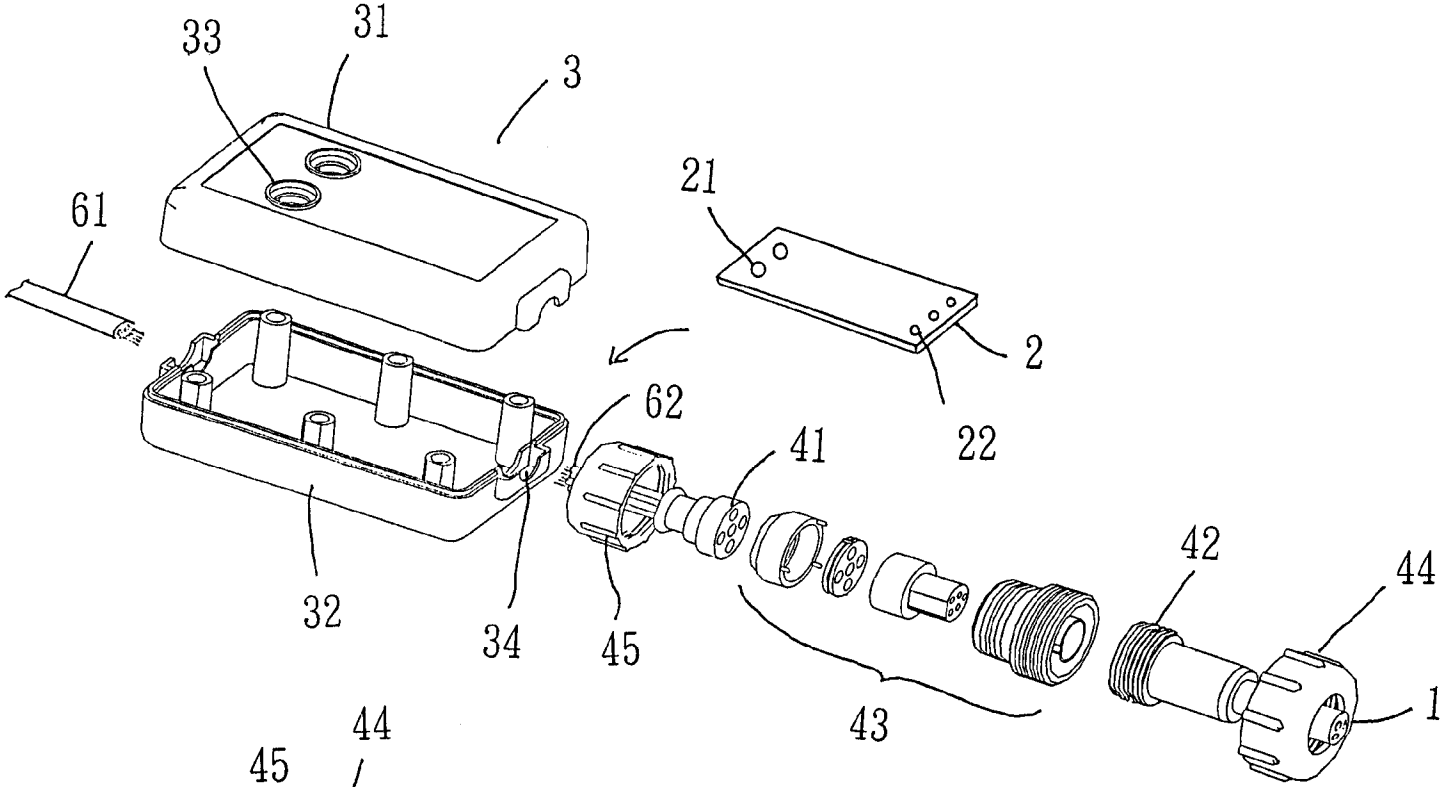
FIG. 3 is a three dimensional exploded view of the present invention.
Figure 2:
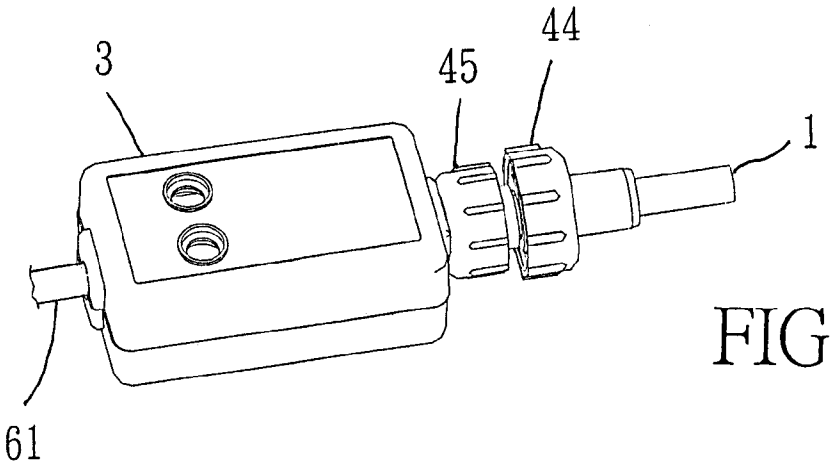
FIG. 2 is a three dimensional assembly view of the present invention.

For understanding the multi-functional ornamental lighting equipment of the present invention, please refer to FIGS. 1 through 3 simultaneously. The lighting equipment of the present invention is composed of an ornamental lighting load 1, a function controller 2 together with its protective housing 3, a connector unit 4, and a power supply 5.

The ornamental lighting load 1 is connected with a plurality of branch circuits each formed of a light string containing several lamps, and then these light strings are connected in series, parallel, or series-parallel to configurate into a desired figure, picture, or character(s) so as to appear as flexible ornamental lighting products or rope lighting products. The unit lighting element may be an incandescent lamp or a LED.

The function controller 2 is a multi-electronic composition formed of a plurality of ICs and a variety of electric and electronic components so as to be functional as a switching device, time counting device capable of rapidly bringing the ornamental lighting load 1 to a starting position to variably changing its state. Moreover, the function controller 2 is provided with an electronic synchronizing device and a prescribed IR/RF signal transmitting/receiving device. The former is functional for synchronizing operation and the latter is capable of transmitting and receiving the prescribed signal in the manner of remote control by means of coding or decoding, and capable of compatibly connecting with a computer, wireless mouse, wireless keyboard, wireless internet, distributor, wireless internet card, and portable cellular phone for practical application. One terminal of the function controller 2 is connected to the power input terminal, and the other terminal is an output terminal to the multi-branch circuits.

The protective housing 3 is an enclosure of the function controller 2. A hole is reserved for assembling a replaceable extra functional module for special application in the case the capability of the function controller has to be improved or supplemented. The replaceable extra functional module is a memory module, scrambler module, coder or decoder module, SIM module or internet module. Respective conductors, plugs, male and female terminals or contactors are reserved for the replaceable extra functional module and the function controller 2 itself.

The connector unit 4 connected with the protective housing 3 admits jointing a plurality of conductors within it. One terminal of the conductors is connected to the output terminal of the function controller 2, while the other terminal thereof is connected to the ornamental lighting load. The way of connection is a plug and receptacle coupling by providing a plurality of male/female terminals in the plug and receptacle coupling mated fixedly with a fastener. The mated portions may be configurated into protuberances and recesses in planar or curved contact surfaces of a variety of sizes and shapes so as to assure a precise position when assembling. Besides, the mated portion may be formed of annular flanges and fissures of various sizes, shapes and numbers for discrimination so as to assure a precise and reliable combination. The above mentioned replaceable extra functional module is sandwiched between the male and female terminals of the plug and receptacle. The replaceable extra function module is a memory module, scrambler module, coder or decoder module, SIM module or internet module, Respective conductors, plugs and receptacle and the replaceable extra functional module so as to interconnect the power source and the multi-circuit lighting load. A protector is provided in the connector unit 4 to protect the lighting load. The protector may be replaceable fusing element being installed in the male terminal of hot line conductor (plus side) to protect the circuit after the plug and receptacle are coupled together.

The power supply 5 is connected to the input terminal of the function controller 2. The power supply 5 is a socket to admit the insertion of the plug blades of the function controller 2 protruded out of its protective housing 3, or has conducting blades to insert into and fixed in the protective housing.

For further understanding the detailed construction of the protective housing 3 and the connector unit 4, please refer to the following description in conjunction with the FIG. 2 and FIG. 3. The protective housing 3 is composed of an upper housing 31 and a lower housing 32. Two via holes 33 are provider on the top surface of the upper housing 31 for installation of an adjusting switch. A breach 34 is formed at the front and rear side surface at the contact portion of the upper and lower housing 31, 32 to allow passing a conductor 61 connected to the power source and a conductor 62 connected to the ornamental lighting load and at the same time, both conductors 61, 62 are in connection with the function controller 2 accommodated in the protective housing 3, that is, the conductors 61 and 62 are respectively connected to the input and output terminals of the function controller 2.

The connector unit 4 is, as a matter of fact, a plug 41 and receptacle 42 combination in which a plurality of conductors passes through with a replaceable extra functional module 43 sandwiched therebetween. The two sides of the plug and receptacle combination 41, 42 are provided with two fasteners 44, 45 to securely grip the functional module 43 between the plug 41 and receptacle 42 such that the functional module 43 is able to control the variation of the lighting effect through controlling the electric signals passing through the conductors with its prescribed capability.

Figure 4:
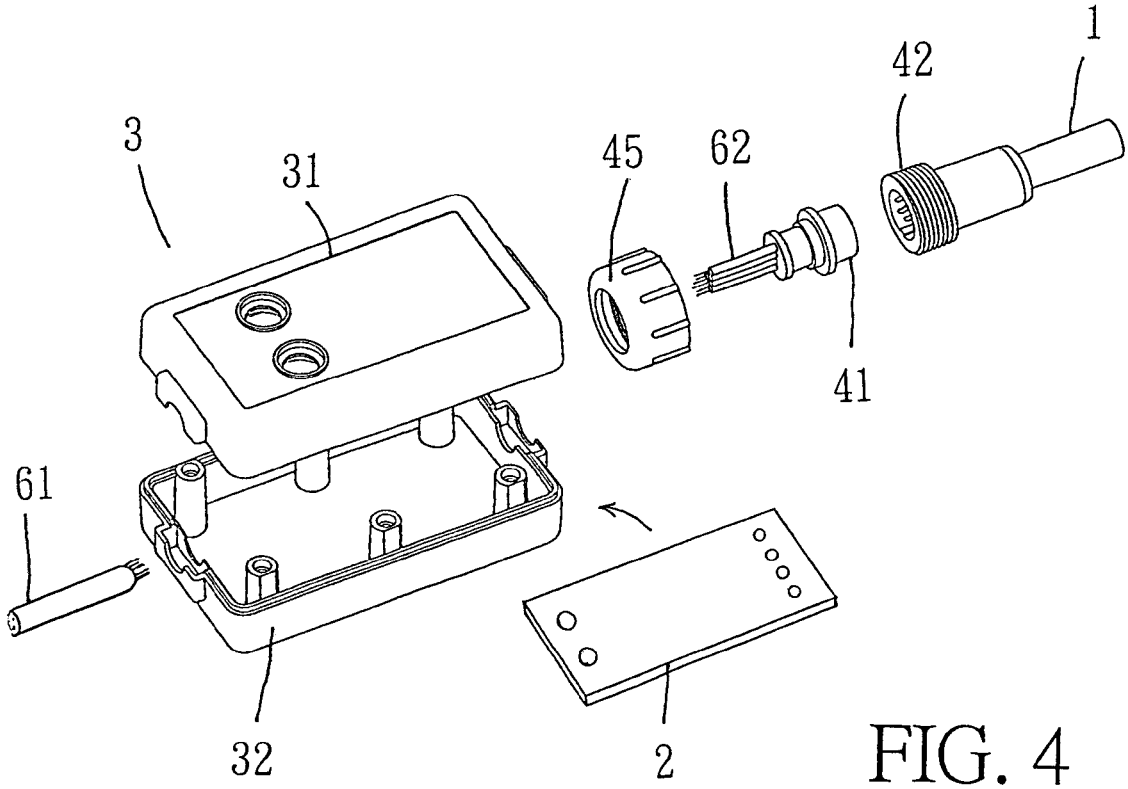
FIG. 4 is a three dimensional exploded view in another embodiment of the present invention.
Figure 5:
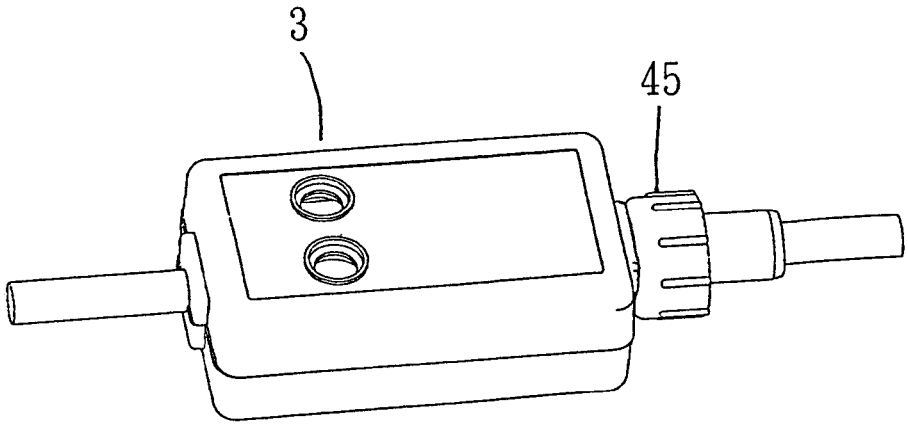
FIG. 5 is a three dimensional assembly view in another embodiment of the present invention.

The multi-functional ornamental lighting equipment according to the second embodiment of the present invention is shown in FIGS. 4 and 5 in which none of the extra function module is inserted between the plug 41 and the receptacle 42. After mating the plug 41 and receptacle 42, the coupled 41 and 42 are fixed by the fastener 45 by passing it through the plug 41 and screw combined with the threads provided around the outer surface of the receptacle 42, the load side conductor 62 is inserted into the protective housing 3 from the breach 34 formed between the upper and lower housings 31 and 32 and connected with the function controller 2. On the other hand, the source side conductor 61 is connected with the function controller 2 from the other side thereby completing assembly of the second embodiment.

Figure 6:
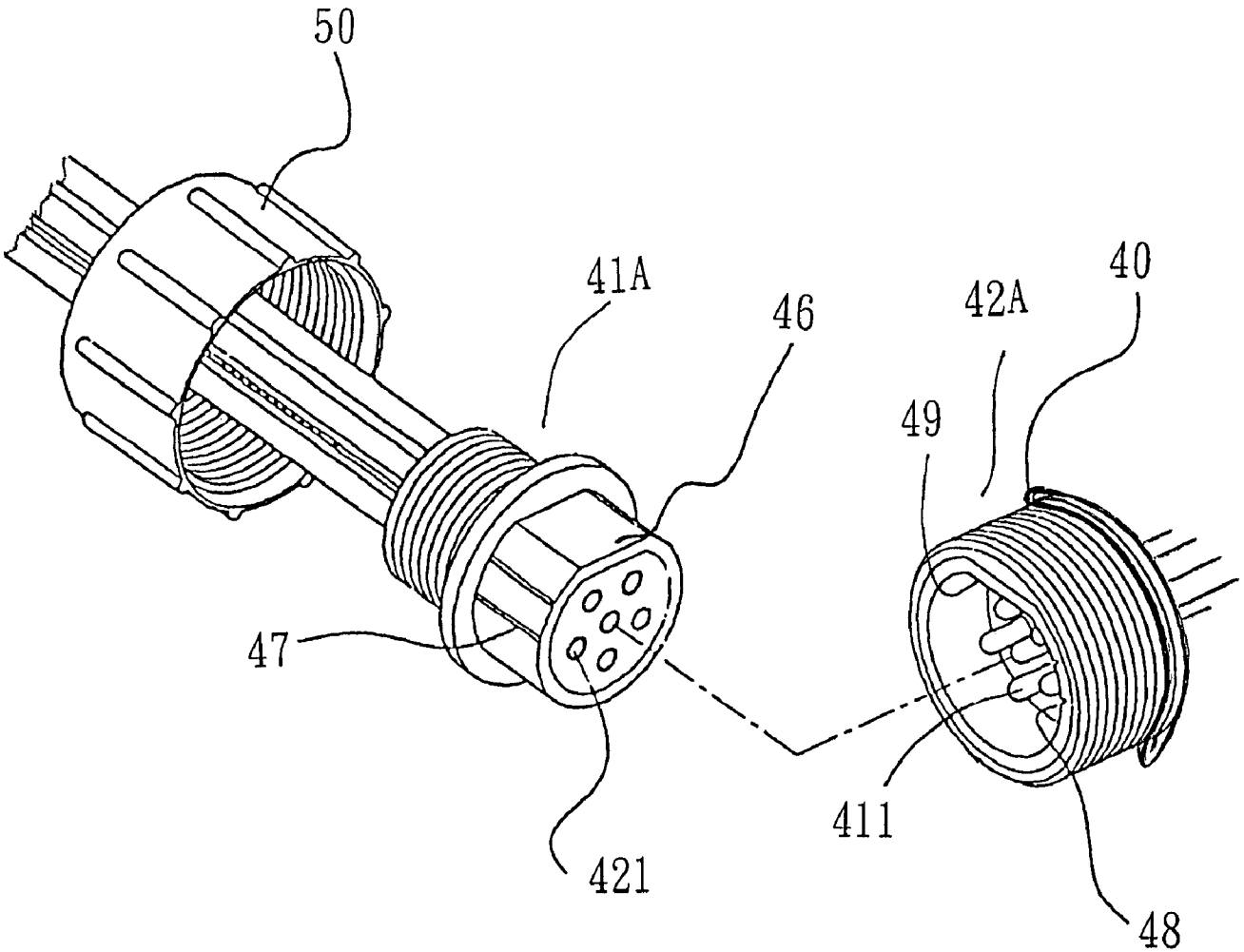
FIG. 6 is a three dimensional exploded view showing mating of a plug with a receptacle in another embodiment of the present invention.

As for the connector unit 4, please refer to FIG. 6 in which an annular flange 40 is formed around the bottom portion of a receptacle 42A to be inlaid into the wall of the protecting housing 3 such that the two components are conjoined together with the aid of a positioning planar face 46, a protruded stria 47, a fissure 48 and a flat face 49. Furthermore, a fastener 50 passes the plug 41A and is screw combined with the threads provided around the outer surface of the receptacle 42A.

Figure 7A:
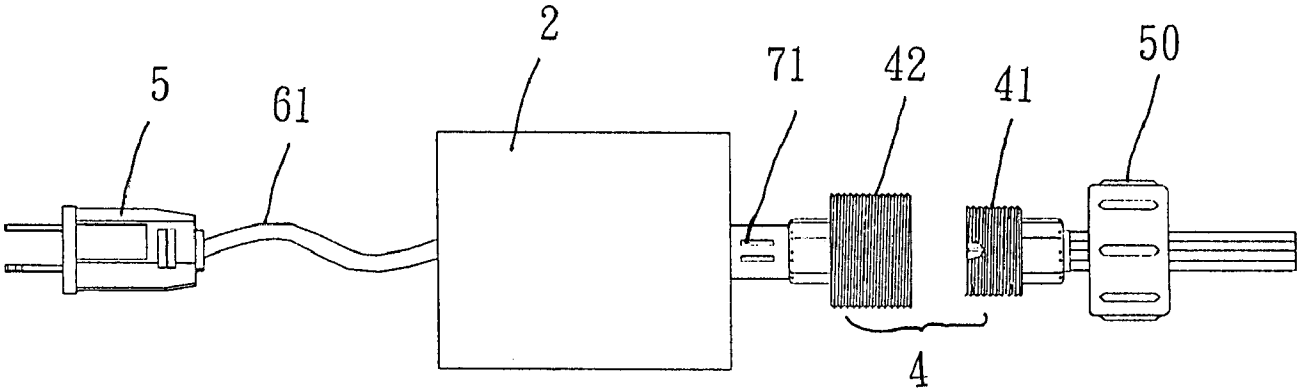
FIG. 7A is a schematic view in which a fuse element is inserted between the plug and receptacle connector and the function controller.
Figure 7B:
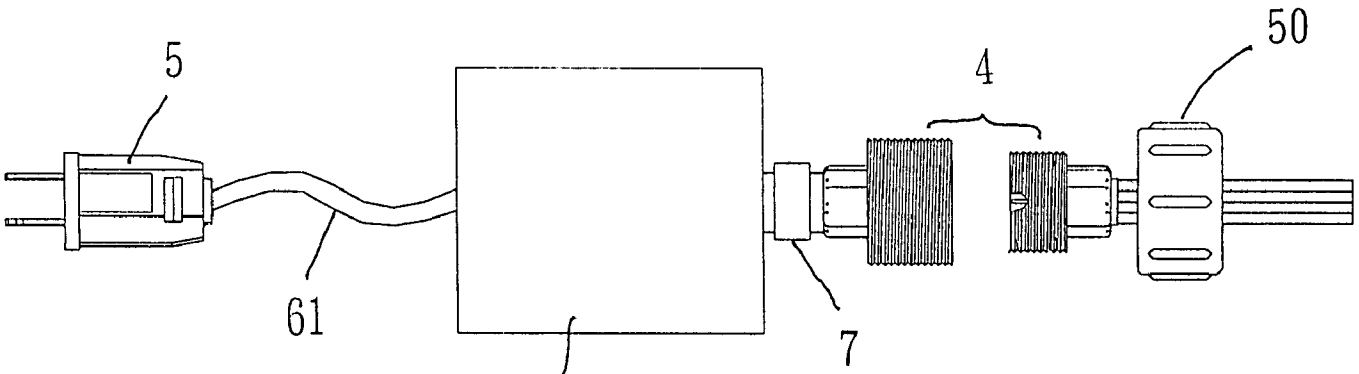
FIG. 7B is a schematic view in which a protector is inserted between the plug and receptacle connector and the function controller.

Besides, as shown in FIGS. 7A and 7B, a protector 7 may be installed between the connector unit 4 and the function controller 2. The protector 7 is composed of outer case and an inner replaceable fuse element 71. One end of the protector 7 is connected to the function controller 2 which being connected to the power supply 5 with the source conductor 61. The other end of the protector 7 is connected to the coupled plug 41 and receptacle 42 which is fixed with the fastener 50 by screwing.

Figure 8:
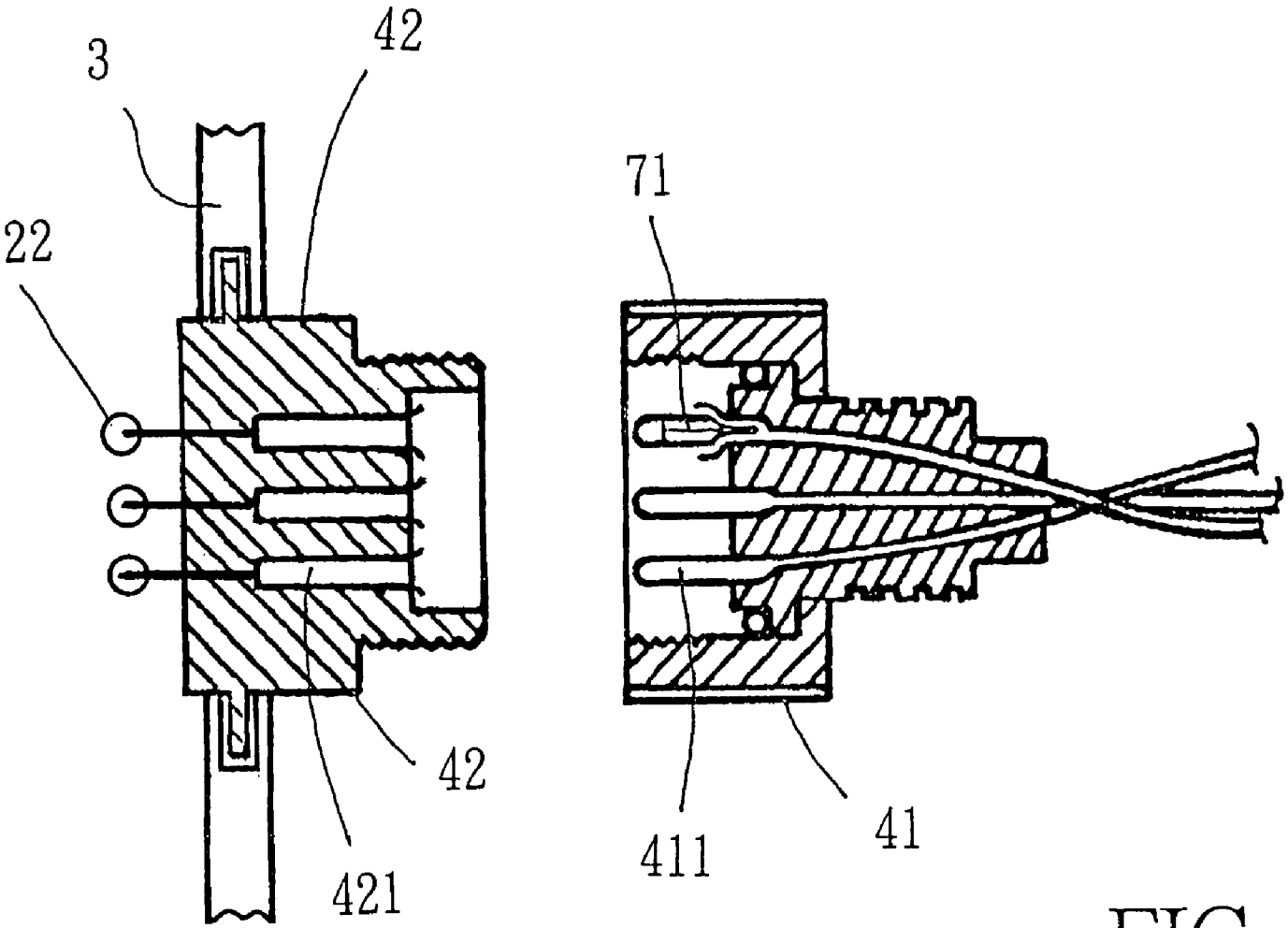
FIG. 8 is a cross sectional view in which a fuse element is inserted between the plug and receptacle in another embodiment.

In another embodiment shown in FIG. 8, an annular ring formed in one end of the receptacle 42 is inlaid into the wall of the protective housing 3, while the other end of the receptacle 42 is connected with a multi-circuit output terminal 22 of the function controller 2. One fuse element 71 is contained per male terminal contactor 411 of the plug 41 so that all the fuse elements 71 are enclosed by the male and female terminal contactors 411 and 421 when the plug 41 and receptacle 42 are coupled together so as to protect the ornamental lighting load. Meanwhile, the fuse element should be installed on the hot line (Plus) side conductor.

Figure 9:
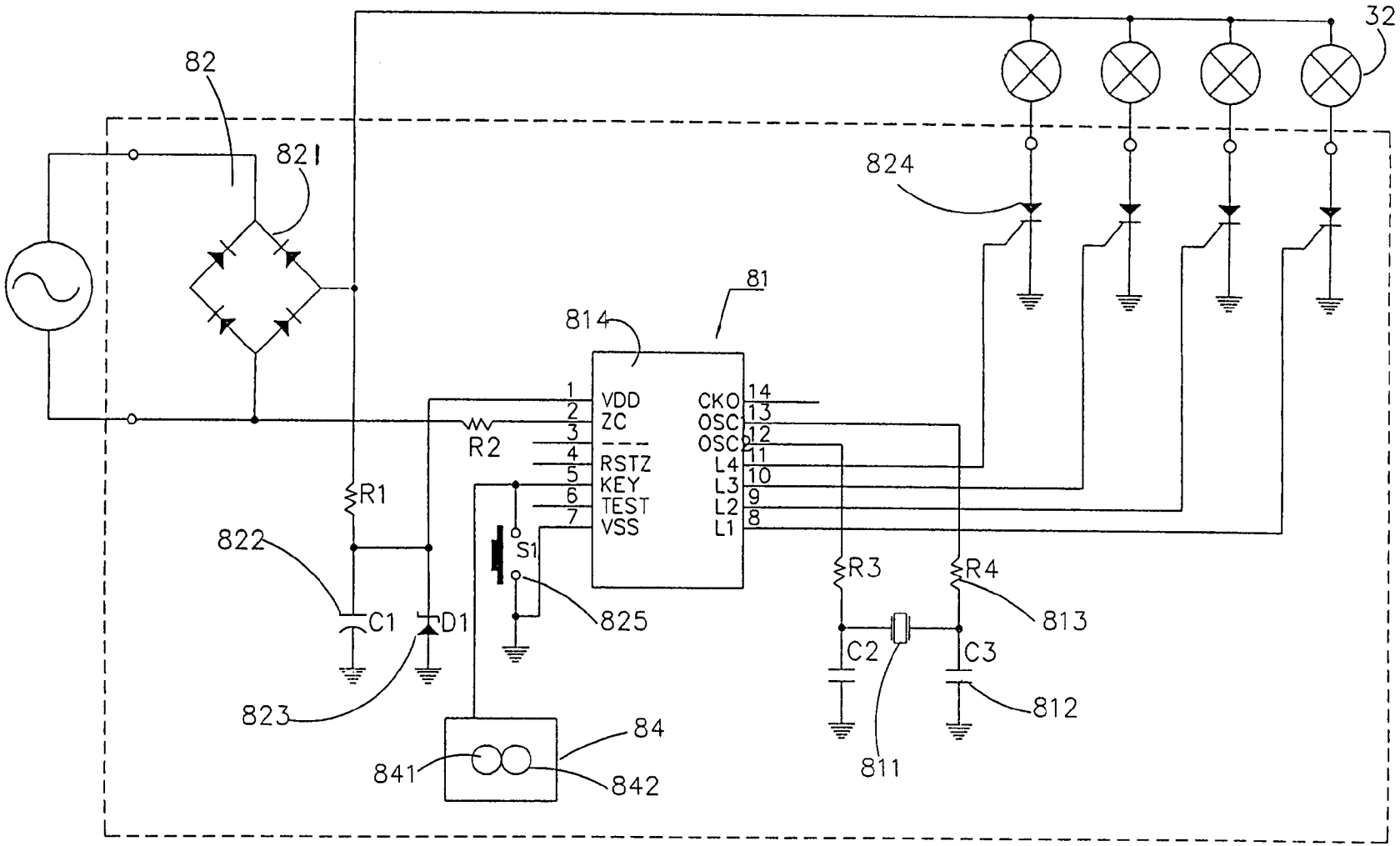
FIG. 9 is an electric circuit diagram of the function controller.

The detail construction and the operational principles about the function controller 2 are illustrated in FIG. 9. Referring to FIG. 9, the function controller 2 includes an IC unit 81 for receiving power supply, signals and operating according to a prescribed mission and delivering a control signal; several auxiliary components 82 for the IC unit 81 for adjusting and varying the intensity and strength of the electric device; a power input terminal 21 for connecting the IC unit 81, and its auxiliary component 82 with the powering supply 5. The IC unit 81, which has the synchronizing effect, is composed of a quartz oscillator 811, a capacitor 812 and a resistor 813 to form an oscillating circuit and generate a reference frequency required for operating the components for the IC unit 82 so as to achieve a synchronizing effect. The auxiliary component 82 for the IC unit 81 includes a rectifier 821, a capacitor 822, a Zener diode 823, a SCR 824, a switch 825, and connector terminals for varying, regulating, stabilizing, pushing and actuating the operation of the ornamental lighting load, and interconnecting and protecting all the components in the IC unit 81.

There is an additional signal transmitter/receiver 84 in which a signal generator 841 and a signal receiver 842 are combined in an integral unit. The operative wireless signals include infrared ray (IR) and radio frequency (RF).

With this scheme, the power is introduce to the IC unit and its auxiliary components by the conductor to operate the light strings to produce turn on/off effect, and then any one of the IC unit generates signals to each IC unit so as to start or reset each of the lamp strings with a similar prescribed electric function thereby enabling a plurality of lamp strings to operate synchronically.

It is not so important that either the IC unit possess a memory function or not. The important thing is that all the lamp strings connected to the same power supply source and the signal transmitter may turn on or off synchronically after being energized from the same power supply source. All the working lamp strings energized form the same power supply output a frequency of similar wave form to the IC unit being rectified by the rectifier and modified by the register so as to obtain a standard frequency for aligning the operation of the lamp strings to the same initiation point during an interrupted time interval thereby regulating the deviation between the characteristic of the quartz oscillator and the auxiliary IC component resulting in unanimous twinkling of the lamps.

Alternatively, the IC unit and its auxiliary components together with the signal transmission wires may be removed and replaced by a signal transmitter and receiver so as to perform the signal transmission in wireless manner by infrared ray or microwave RF. The signal transmitter and receiver may be combined integrally in one piece. For practicability, the IC unit may be offered prescribed switching or restart function using automatic or manual switching means.

With this scheme, the IC unit provides control signals to the signal transmitter which then transmitted to the signal receivers for all lamp strings so as to start or re-start each lamp string, even a farmost one will not fail to keep synchronous operation.

Figure 10:
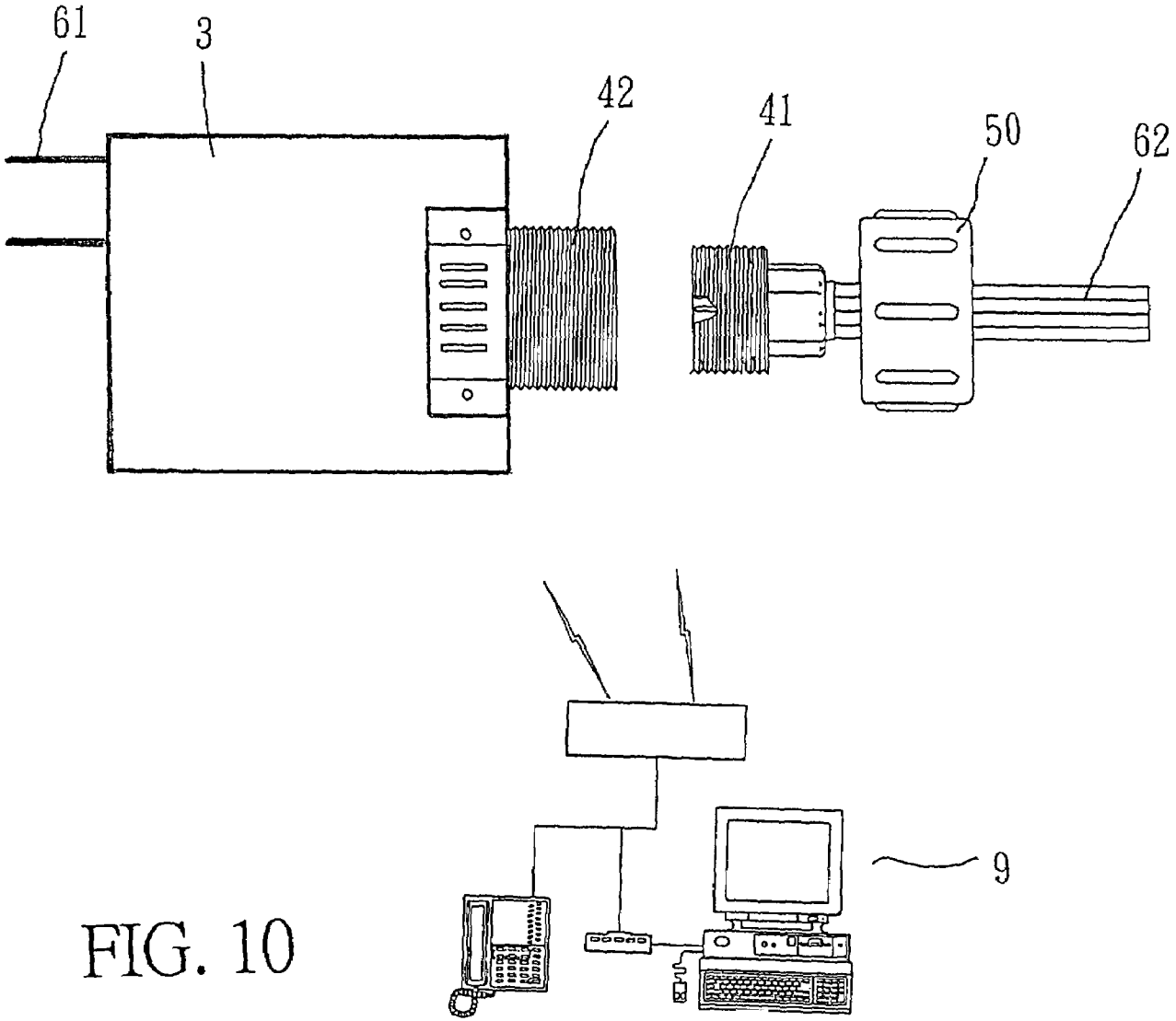
FIG. 10 is an exemplary view showing the function controller of the present invention is compatibly connected with an electronic device such as a computer for application in another embodiment.

In another embodiment shown in FIG. 10, wherein one end of the protective housing 3 is connected to the conductor 61, and the other end thereof is connected to the conductor 62 via plug and receptacle coupling 41 and 42 fixed by the fastener 50. The IR or RF signal/transmitter accommodated in the function controller 2 enclosed in the protective housing 3 may transmit or receive the prescribed signal for performing remote control by means of an encoder or decoder. Similarly, the assembly can be compatibly connected with a computer 9, a mouse, a wireless keyboard, a wireless internet, a distributor, an internet card, or a cellular phone.

Other embodiments of the present invention will become obvious to those skilled in the art in light of the above disclosure. It is of course also understood that the scope of the present invention is not to be determined by the foregoing description, but only by the following claims.

What is claimed is:

1. A multi-functional ornamental lighting equipment comprising:

an ornamental lighting load connected to form a plurality of branch circuits;

a function controller formed of a variety of electric and electronic components operable for various prescribed functions, and having a power supply input terminal and an output terminal to multi-branched circuit;

a protective housing for enclosing said function controller, said protective housing being externally provided with a replaceable extra functional module for special application when a capability of said function controller is to be improved or supplemented;

a connector unit connected with said protective housing and admitting to joint a plurality of conductors within it, one terminal of said conductors being connected to the output terminal of said function controller, while the other terminal thereof being connected to said ornamental lighting load;

and a power supply connected to the input terminal of said function controller; and when the power is supplied to said ornamental lighting equipment by said energized function controller via said connector unit, said lighting equipment is capable of rapidly reaching at a starting position ready for variably changing its state.

2. The lighting equipment of claim 1, wherein said ornamental lighting load includes a plurality of light strings connected in series, parallel, or series-parallel.

3. The lighting equipment of claim 2, wherein the unit lighting element is an incandescent lamp or a LED.

4. The lighting equipment of claim 3, wherein said plurality of light strings are connected in series, parallel, or series-parallel to form a desired figure, picture, or character (s).

5. The lighting equipment of claim 3, wherein said lighting elements are composed to appear as flexible ornamental lighting products or rope lighting products.

6. The lighting equipment of claim 2, wherein said plurality of light strings are connected in series, parallel, or series-parallel to form a desired figure, picture, or character (s).

7. The lighting equipment of claim 2, wherein said lighting elements are composed to appear as flexible ornamental lighting products or rope lighting products.

8. The lighting equipment of claim 1, wherein said function controller is formed of a plurality of ICs and a variety of electric and electronic components so as to function as a switching device, a time counting device, a dimmer, and capable of sequential or random operation.

9. The lighting equipment of claim 1, wherein said replaceable extra functional module is a memory module, scrambler module, coder or decoder module, SIM module, or internet module.

10. The lighting equipment of claim 1, wherein said protecting housing reserves a side hole for assembling said replaceable extra functional module.

11. The lighting equipment of claim 1, wherein said function controller and said replaceable extra functional module are respectively provided with conductors, plugs, male and female terminals and contactors to connect with the power supply and the multi-branch circuit lighting load.

12. The lighting equipment of claim 1, wherein said connector unit is formed of a plug and a receptacle.

13. The lighting equipment of claim 12, wherein the plug and receptacle of said connector unit respectively include a plurality of male and female terminals.

14. The lighting equipment of claim 13, wherein said replaceable extra functional module is sandwiched between the male and female terminals of said connector unit to assist operation of said function controller.

15. The lighting equipment of claim 14, wherein said replaceable extra function module is a memory module, scrambler module, coder or decoder module, STM module, or internet module.

16. The lighting equipment of claim 14, wherein conductors, plugs, male and female terminals and contact positions are respectively assigned for said connector unit and said replaceable extra functional module so as to interconnect said power supply and said multi-circuit lighting load.

17. The lighting equipment of claim 12, wherein the coupled plug and receptacle is fixed tightly with a fastener.

18. The lighting equipment of claim 1, wherein said power supply is a socket to admit the insertion of the plug blade at the input terminal of said function controller and protruded out of said protective housing.

19. The lighting equipment of claim 1, wherein said power supply has conducting blades to insert into and fixed on said protective housing so as to connect with the input terminal of said function controller.

20. A multi-functional ornamental lighting equipment comprising:

an ornamental lighting load connected to form a plurality of branch circuits;

a function controller formed of a variety of electric and electronic components operable for various prescribed functions, and having a power supply input terminal and an output terminal to multi-branched circuit, said function controller being formed of a plurality of ICs and a variety of electric and electronic components so as to function as a switching device, a time counting device, a dimmer, and being capable of sequential and random operation;

a protective housing for enclosing said function controller;

a connector unit being a plug and receptacle coupling connected with said protective housing, wherein a plurality of male and female terminals are respectively contained in said plug and receptacle, one end of said connector unit is connected with the output terminal of said function controller, while the other terminal thereof is connected to said ornamental lighting load, said plug and receptacle are mated with each other with said male and female terminals and said plug and receptacle are mated fixedly with a fastener;

a power supply connected to the input terminal of said function controller; and when the power is supplied to said ornamental lighting equipment by said energized function controller via said connector unit, said lighting equipment is capable of rapidly reaching at a starting position ready for variably changing its state.

21. The lighting equipment of claim 20, wherein said ornamental lighting load includes a plurality of lighting strings connected in series, parallel, or series-parallel.

22. The lighting equipment of claim 21, wherein the unit lighting element is an incandescent lamp or a LED.

23. The lighting equipment of claim 22, wherein said plurality of light strings are connected in series, parallel, or series-parallel to form a desired figure, picture, or character (s).

24. The lighting equipment of claim 22, wherein said lighting elements are composed to appear as flexible ornamental lighting products or rope lighting products.

25. The lighting equipment of claim 21, wherein said plurality of light strings are connected in series, parallel, or series-parallel to form a desired figure, picture, or character (s).

26. The lighting equipment of claim 21, wherein said lighting elements are composed to appear as flexible ornamental lighting products or rope lighting products.

27. The lighting equipment of claim 20, wherein said function controller is provided with an electronic synchronizing device to produce a prescribed frequency or signal thereby achieving the synchronous operation effect.

28. The lighting equipment of claim 20, wherein said function controller is provided with a prescribed IR/RF signal transmitting/receiving device capable of transmitting and receiving the prescribed signal in the manner of remote control.

29. The lighting equipment of claim 28, wherein said function controller transmits and receives signals by means of coding or decoding.

30. The lighting equipment of claim 28, wherein said function controller is capable of operating compatibly connected with a computer, wireless mouse, wireless keyboard, wireless internet, distributor, wireless internet card, and portable cellular phone for performing its function.

31. The lighting equipment of claim 20, wherein said protective housing is externally provided with a replaceable extra functional module for special application when the capability of said function controller is to be improved or supplemented.

32. The lighting equipment of claim 31, wherein said replaceable extra functional module is a memory module, scrambler module coder or decoder module, SIM module, or internet module.

33. The lighting equipment of claim 31, wherein said protecting housing reserves a side hole for assembling said replaceable extra functional module.

34. The lighting equipment of claim 31, wherein said function controller and said replaceable extra functional module are respectively provided with conductors, plugs, male and female terminals and contactors to connect with the power supply and the multi-branch circuit lighting load.

35. The lighting equipment of claim 20, wherein said protecting housing reserves a side hole for assembling said replaceable extra functional module.

36. The lighting equipment of claim 20, wherein said function controller and said replaceable extra functional module are respectively provided with conductors, plugs, male and female terminals and contactors to connect with the power supply and the multi-branch circuit lighting load.

37. The lighting equipment of claim 20, wherein the mating portions of said male and female terminals are configurated into protuberances and recesses in planar or curved contact surfaces of a variety of sizes and shapes so as to assume a precise position for assembling.

38. The lighting equipment of claim 20, wherein the mating portions of said male and female terminals are formed of annular flanges and fissures in various sizes, shapes, and numbers for discrimination so as to assure a precise and reliable combination.

39. The lighting equipment of claim 20, wherein said replaceable extra functional module is sandwiched between the male and female terminals of said connector unit to assist operation of said function controller.

40. The lighting equipment of claim 39, wherein said replaceable extra function module is a memory module, scrambler module, coder or decoder module, STM module, or internet module.

41. The lighting equipment of claim 39, wherein conductors, plugs, male and female terminals and contact positions are respectively assigned for said connector unit and said replaceable extra functional module so as to interconnect said power supply and said multi-circuit lighting load.

42. The lighting equipment of claim 20, wherein said connector unit is provided with a protector to protect said lighting equipment.

43. The lighting equipment of claim 42, wherein said protector is replaceable.

44. The lighting equipment of claim 42, wherein said protector is a fusing element.

45. The lighting equipment of claim 42, wherein said protector is inserted in the hot line conductor.

46. The lighting equipment of claim 42, wherein said protector is installed on the male terminal side of said connector unit to be connected with the female terminal.

47. The lighting equipment of claim 20, wherein said power supply is a socket to admit the insertion of the plug blade at the input terminal of said function controller and protruded out of said protective housing.

48. The lighting equipment of claim 20, wherein said power supply has conducting blades to insert into and fixed on said protecting housing so as to connect with the input terminal of said function controller.

49. A multi-functional ornamental lighting equipment comprising:

an ornamental lighting load connected to form a plurality of branch circuits;

a function controller formed of a variety of electric and electronic components operable for various prescribed functions, and having a power supply input terminal and an output terminal to multi-branched circuit, said function controller being provided with an electronic synchronizing device to produce a prescribed frequency or signal thereby achieving a synchronous operation effect;

a protective housing for enclosing said function controller;

a connector unit connected with said protective housing and admitting to joint a plurality of conductors within it, one terminal of said conductors being connected to the output terminal of said function controller, while the other terminal thereof being connected to said ornamental lighting load;

and a power supply connected to the input terminal of said function controller;

when the power is supplied to said ornamental lighting equipment by said energized function controller via said connector unit, said lighting equipment is capable of rapidly reaching at a starting position ready for variably changing its state.

50. A multi-functional ornamental lighting equipment comprising:

an ornamental lighting load connected to form a plurality of branch circuits;

a function controller formed of a variety of electric and electronic components operable for various prescribed functions, and having a power supply input terminal and an output terminal to multi-branched circuit, said function controller being provided with a prescribed IR/RF signal transmitting/receiving device capable of transmitting and receiving a prescribed signal in a manner of remote control;

a protective housing for enclosing said function controller;

a connector unit connected with said protective housing and admitting to joint a plurality of conductors within it, one terminal of said conductors being connected to the output terminal of said function controller, while the other terminal thereof being connected to said ornamental lighting load;

and a power supply connected to the input terminal of said function controller;

when the power is supplied to said ornamental lighting equipment by said energized function controller via said connector unit, said lighting equipment is capable of rapidly reaching at a starting position ready for variably changing its state.

51. The lighting equipment of claim 50, wherein said function controller transmits and receives signals by means of coding or decoding.

52. The lighting equipment of claim 50, wherein said function controller is capable of operation compatibly connected with a computer, wireless mouse, wireless keyboard, wireless internet, distributor, wireless internet card, and portable cellular phone for performing its function.

53. A multi-functional ornamental lighting equipment comprising:

an ornamental lighting load connected to form a plurality of branch circuits;

a function controller formed of a variety of electric and electronic components operable for various prescribed functions, and having a power supply input terminal and an output terminal to multi-branched circuit;

a protective housing for enclosing said function controller;

a connector unit connected with said protective housing and admitting to joint a plurality of conductors within it, one terminal of said conductors being connected to the output terminal of said function controller, while the other terminal thereof being connected to said ornamental lighting load, said connector unit being formed of a plug and a receptacle which respectively include a plurality of male and female terminals, mating portions of said male and female terminals being configurated into protuberances and recesses in planar or curved contact surfaces of a variety of sizes and shapes so as to assure a precise position for assembling;

and a power supply connected to the input terminal of said function controller;

when the power is supplied to said ornamental lighting equipment by said energized function controller via said connector unit, said lighting equipment is capable of rapidly reaching at a starting position ready for variably changing its state.

54. A multi-functional ornamental lighting equipment comprising:

an ornamental lighting load connected to form a plurality of branch circuits;

a function controller formed of a variety of electric and electronic components operable for various prescribed functions, and having a power supply input terminal and an output terminal to multi-branched circuit;

a protective housing for enclosing said function controller;

a connector unit connected with said protective housing and admitting to joint a plurality of conductors within it, one terminal of said conductors being connected to the output terminal of said function controller, while the other terminal thereof being connected to said ornamental lighting load, said connector unit being formed of a plug and a receptacle which respectively include a plurality of male and female terminals, mating portions of said male and female terminals being formed of annular flanges and fissures in various sizes, shapes, and numbers for discrimination so as to assure a precise and reliable combination;

and a power supply connected to the input terminal of said function controller;

when the power is supplied to said ornamental lighting equipment by said energized function controller via said connector unit, said lighting equipment is capable of rapidly reaching at a starting position ready for variably changing its state.

55. A multi-functional ornamental lighting equipment comprising:

an ornamental lighting load connected to form a plurality of branch circuits;

a function controller formed of a variety of electric and electronic components operable for various prescribed functions, and having a power supply input terminal and an output terminal to multi-branched circuit;

a protective housing for enclosing said function controller;

a connector unit connected with said protective housing and admitting to joint a plurality of conductors within it, one terminal of said conductors being connected to the output terminal of said function controller, while the other terminal thereof being connected to said ornamental lighting load, said connector unit being provided with a protector to protect said lighting equipment;

and a power supply connected to the input terminal of said function controller;

when the power is supplied to said ornamental lighting equipment by said energized function controller via said connector unit, said lighting equipment is capable of rapidly reaching at a starting position ready for variably changing its state.

56. The lighting equipment of claim 55, wherein said protector is replaceable.

57. The lighting equipment of claim 55, wherein said protector is a fusing element.

58. The lighting equipment of claim 55, wherein said protector is inserted in the hot line conductor.

59. The lighting equipment of claim 55, wherein said protector is installed on the male terminal side of said connector unit to be connected with the female terminal.

60. A multi-functional ornamental lighting equipment comprising:

an ornamental lighting load connected to form a plurality of branch circuits;

a function controller formed of a variety of electric and electronic components operable for various prescribed functions, and having a power supply input terminal and an output terminal to multi-branched circuit, said function controller being formed of a plurality of ICs and a variety of electric and electronic components so as to function as a switching device, a time counting device, a dimmer, and being capable of sequential or random operation;

a protective housing for enclosing said function controller;

a connector unit connected with said protective housing and admitting to joint a plurality of conductors within it, one terminal of said conductors being connected to the output terminal of said function controller, while the other terminal thereof being connected to said ornamental lighting load;

and a power supply connected to the input terminal of said function controller; and when the power is supplied to said ornamental lighting equipment by said energized function controller via said connector unit, said lighting equipment is capable of rapidly reaching at a starting position ready for variably changing its state.

* * * * *